US006199548B1

(12) United States Patent
Hsu

(10) Patent No.: US 6,199,548 B1
(45) Date of Patent: Mar. 13, 2001

(54) STRUCTURE OF AN OVEN

(75) Inventor: Tony Hsu, Tainan Hsien (TW)

(73) Assignee: Lundar Electric Industrial Co., Ltd., Tainan Hsien (TW)

( * ) Notice: Subject to any disclaimer, the term of this patent is extended or adjusted under 35 U.S.C. 154(b) by 0 days.

(21) Appl. No.: 09/406,724

(22) Filed: Sep. 28, 1999

Related U.S. Application Data

(63) Continuation-in-part of application No. 09/334,673, filed on Jun. 17, 1999.

(51) Int. Cl.[7] ..... F23M 7/00; E05D 7/10; E06B 3/34

(52) U.S. Cl. ..... 126/194; 126/41 R; 126/190; 16/257; 16/270; 49/41

(58) Field of Search ..... 126/194, 25 R, 126/9 R; 99/340, 421 V; 16/357, 382, 270, 264, 257, 259, 261; 403/192, 7

(56) References Cited

U.S. PATENT DOCUMENTS

| | | | | |
|---|---|---|---|---|
| D. 283,391 | * | 4/1986 | McNiel | D7/332 |
| 429,684 | * | 6/1890 | Hall | 16/257 |
| 1,475,838 | * | 11/1923 | Lamb | 126/194 |
| 2,539,151 | * | 1/1951 | Mills | 126/194 |
| 2,778,053 | * | 1/1957 | Hess et al. | 16/261 |
| 3,045,663 | * | 7/1962 | McDonald | 126/190 |
| 3,180,248 | * | 4/1965 | Mell | 126/25 R |
| 3,343,527 | * | 9/1967 | Manteris | 126/25 R |
| 3,665,913 | * | 5/1972 | Cagle, Jr. | 126/25 R |
| 3,734,076 | * | 5/1973 | Kizol | 126/25 R |
| 3,756,219 | * | 9/1973 | Snyder et al. | 126/194 |
| 3,852,943 | * | 12/1974 | Healy | 16/257 |
| 4,269,165 | * | 5/1981 | Wrotny et al. | 126/194 |
| 4,667,367 | * | 5/1987 | White et al. | 16/270 |
| 4,799,291 | * | 1/1989 | Ankum et al. | 16/259 |
| 4,873,745 | * | 10/1989 | Ramsauer | 16/259 |
| 4,979,264 | * | 12/1990 | Ramsauer | 16/264 |
| 4,996,969 | * | 3/1991 | Dodgan | 126/25 R |
| 5,070,857 | * | 12/1991 | Sarten | 126/25 R |
| 5,097,817 | * | 3/1992 | Dodgen | 126/25 R |
| 5,274,881 | * | 1/1994 | DeRosa | 16/257 |
| 5,483,947 | * | 1/1996 | Giebel et al. | 126/25 R |
| 5,673,613 | * | 10/1997 | Price | 126/25 R |
| 5,738,179 | * | 4/1998 | Matsui | 16/357 |
| 5,866,876 | * | 2/1999 | Stewart, Jr. | 126/25 R |
| 5,934,180 | * | 8/1999 | Lin | 99/340 |
| 5,947,013 | * | 9/1999 | Stewart, Jr. | 126/25 R |

FOREIGN PATENT DOCUMENTS

| | | | | |
|---|---|---|---|---|
| 515329 | * | 8/1954 | (BE) | 16/270 |

* cited by examiner

*Primary Examiner*—Ira S. Lazarus
*Assistant Examiner*—David Lee
(74) *Attorney, Agent, or Firm*—Rosenberg, Klein & Lee

(57) ABSTRACT

A structure of an oven structure, comprised of a lateral, round body and a door panel pivoted to the body that can be lifted to open, and separated by removing the pivot members if required.

1 Claim, 6 Drawing Sheets

STRUCTURE OF AN OVEN

This is a Continuation-in-part of U.S. patent application Ser. No. 09/334,673 filed at the U.S. Patent and Trademark office on Jun. 17, 1999.

BACKGROUND OF THE INVENTION

1. Field of the Invention

The present invention relates to a structure of an oven; and more particularly, to an oven with a lateral door panel pivoted to the body of the oven that can be lifted comprising the arc surface of the body, and can be removed to facilitate cleaning.

2. Description of the Prior Art

Whereas the ovens generally available in the market are of two types, lateral and standing, the present invention is related to a door panel of a lateral oven.

The prior art of the lateral oven has its door panel hinged on one side, and in most cases, said door panel is hinged at a vertical edge, with a few hinged at a horizontal edge to the body of the oven. When in use, the door panel is pulled or drawn out to open with the location of where hinged as the support to fetch or remove the food. However, the prior art of the oven with door panel open consumes a lot of space, and the user may get burned by the door panel which could get very hot and in free movement (swinging laterally in case of vertically hinged or bouncing back in case of laterally hinged). The hinged door panel that can not be removed prevents a thorough cleaning. Therefore, the door panel to an oven of the prior art is not perfect in terms of safety and sanitary. Furthermore, said oven is prevented from giving a multiple of application since its door panel is hinged to the body of the oven.

SUMMARY OF THE INVENTION

The primary objective of the present invention is to provide a structure of an oven, comprised of a lateral, round body of the oven and a door panel. Within, the door panel is pivoted with pivoting members to the body of the oven allowing to be lifted by compromising the arc surface of the oven for double benefits of space-saving and safety concerns.

Another objective of the present invention is to provide a structure of an oven, comprised of a lateral, round body of the oven and a door panel. Within, the door panel is pivoted with pivoting members to the body of the oven and can be separated from the body of the oven by removing said pivoting members to facilitate cleaning and give additional applications.

DETAILED DESCRIPTION OF TIE INVENTION

Figure 1:
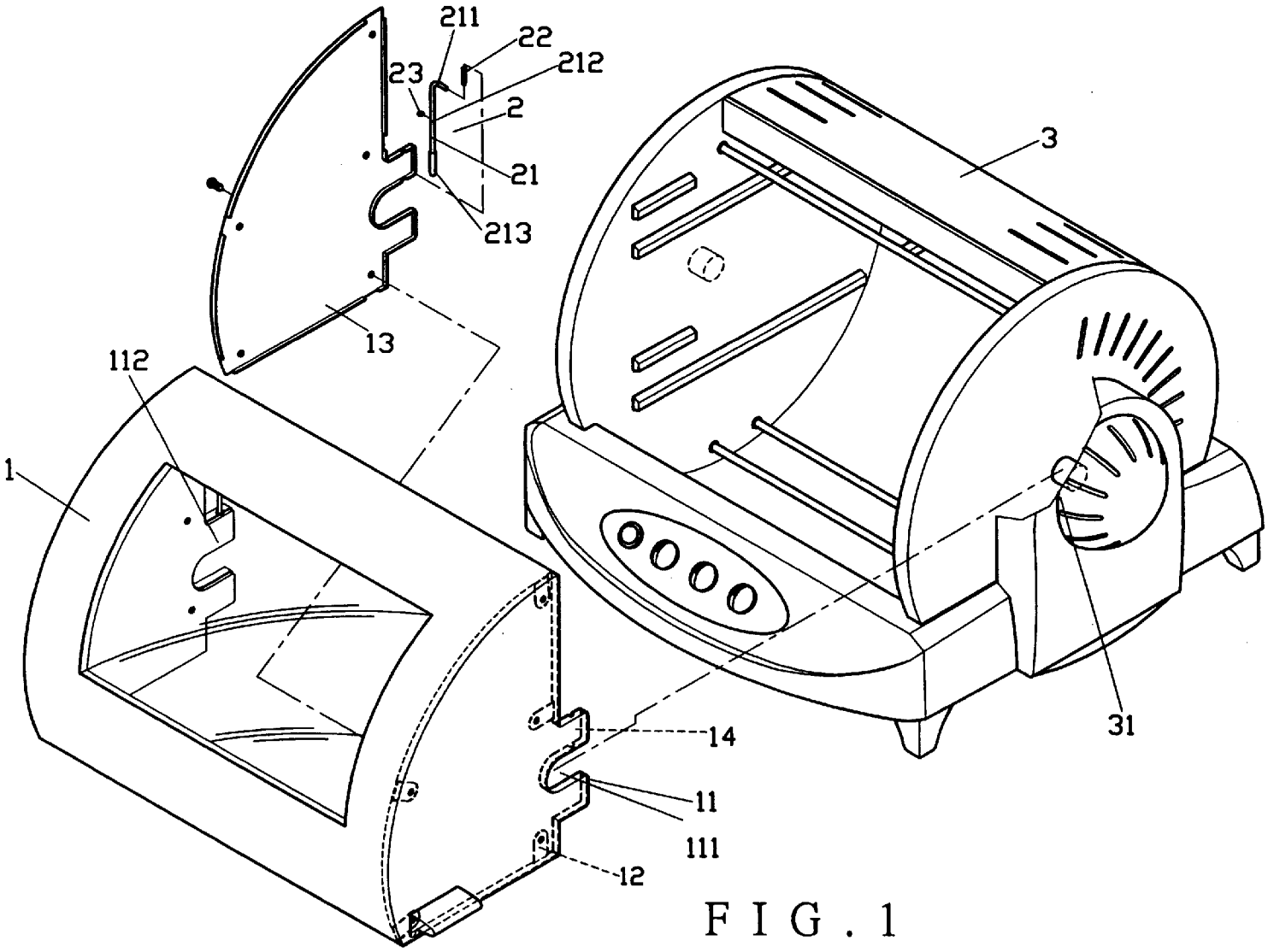
FIG. 1 is a blowout view of the present invention.
Figure 2:
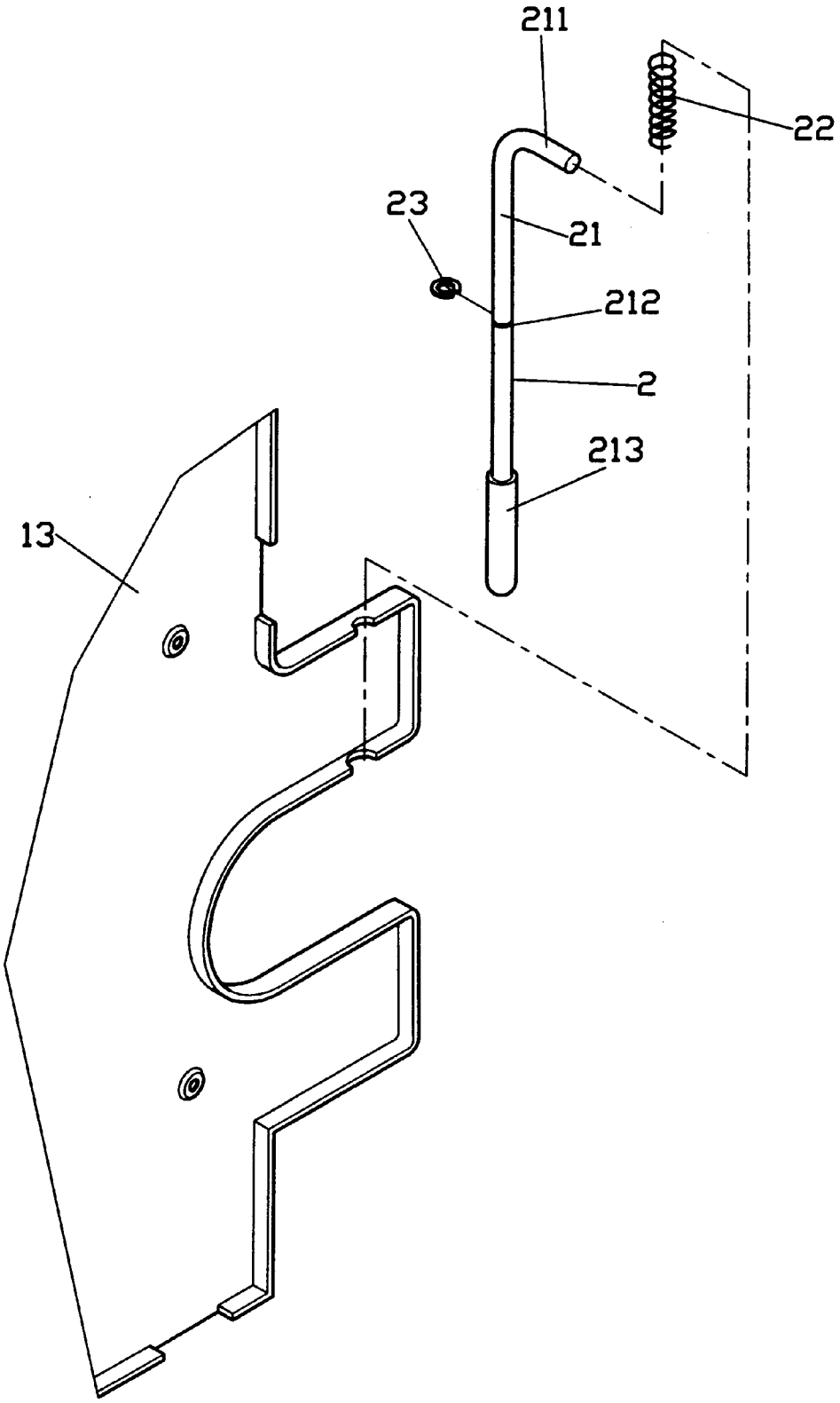
FIG. 2 is a blowout view showing a locality of a preferred embodiment of the present invention.

Referring to FIGS. 1 and 2, a preferred embodiment of the present invention is comprised of a door panel (1), a pivoting unit (2) and a body of an oven (3). Within, the door panel (1) is molded as an arc cover with hollow interior, a pivoting ear (11) with an arc recess (111) at its middle is provided at each narrower edge of the cover. A multiple of curved tab (12) are provided on the inner side corresponding to both sides of the door panel(1). Said tabs (12) are fastened with screws to a lid (13) in shape corresponding to that of the side of the side of the door panel (1) to form an inner space (14). A through hole (112) is provided longitudinally at from the top of the connection ear for mounting a pivoting unit (2).

The pivoting unit (2) is comprised of a locking pin (21), a spring (22) and a clamping ring (23). Within, one end of said locking pin (21) is formed as a curved handle (211) and another end expanded in diameter to form a stopper (213). A groove (212) is provided in the peripheral of the locking pin (21) to hold the clamping ring (23).

A pivoting post (31) in proper length is each protruding respectively from the peripheral of the body of the oven (3) at where corresponding to the arc recess (111) of the pivoting ear (11) at both sides of the door panel (1).

Figure 3:
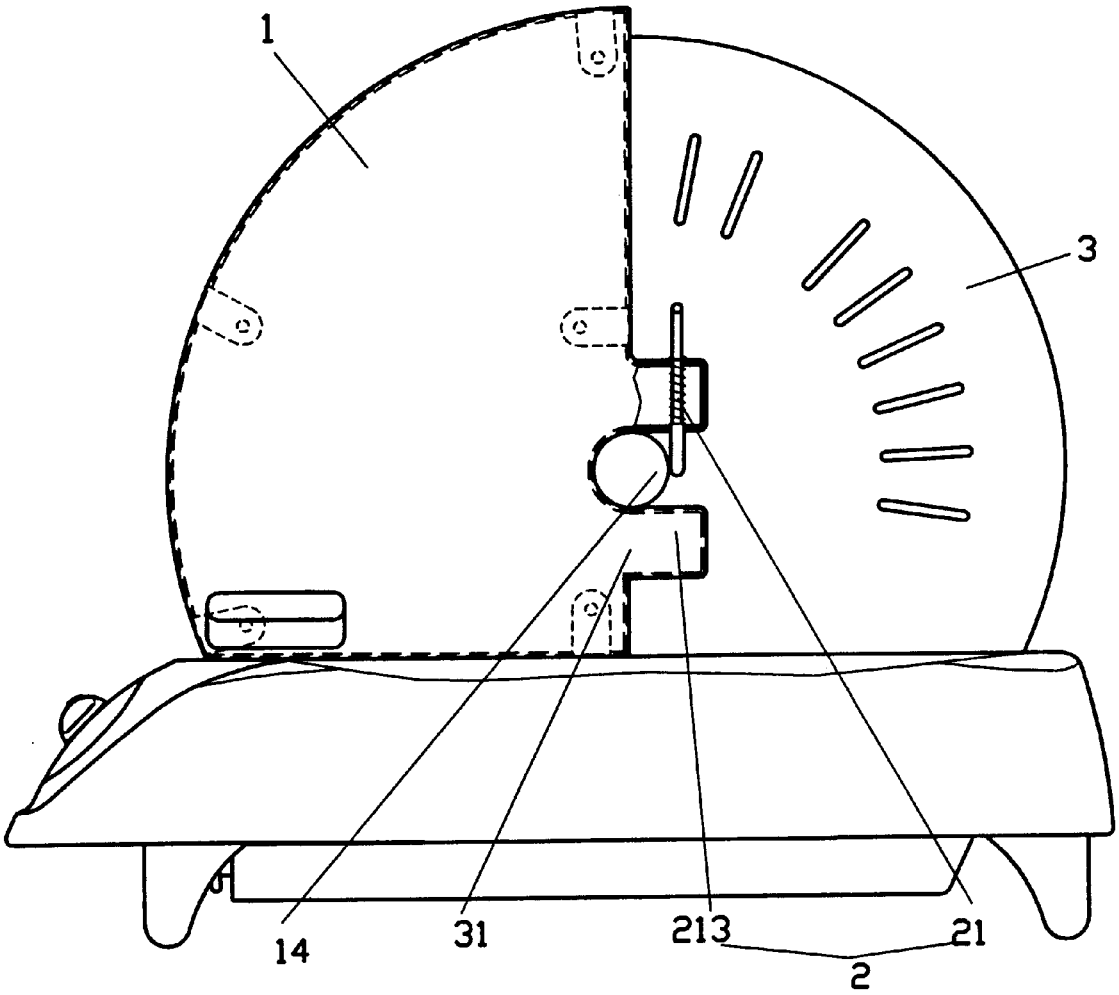
FIG. 3 is a sectional view of an assembly of the preferred embodiment of the present invention.
Figure 4:
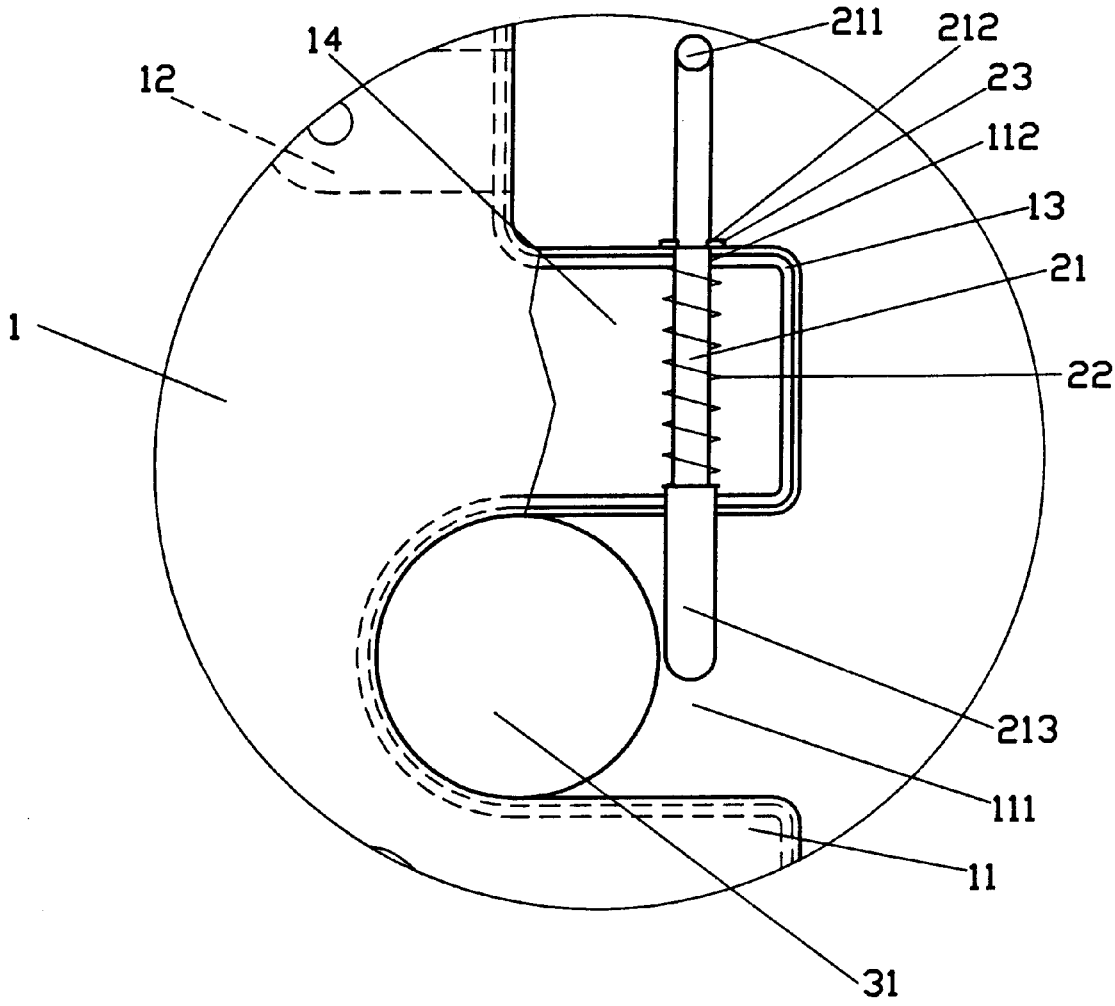
FIG. 4 is a sectional view showing a blowout of a locality of the assembly of the preferred embodiment of the present invention.
Figure 5:
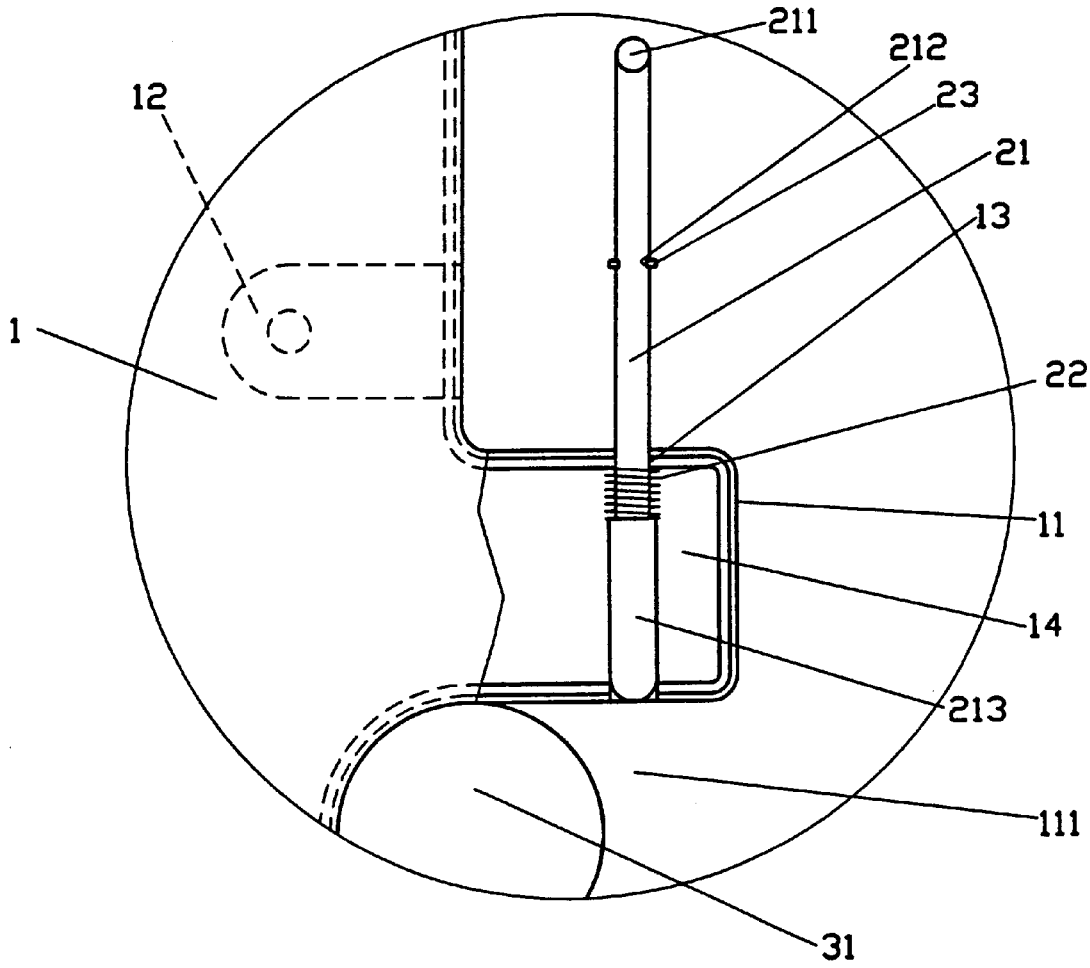
FIG. 5 is a schematic view showing the locality of the opening mechanism of the preferred embodiment of the present invention.

Now referring to FIGS. 3 and 4, upon assembling, the locking pin (21) penetrates through the spring (22) and is accommodated in the inner space (14) of the pivoting ear (11) respectively corresponding to the door panel (1) so to extend in the through hole (112). A clamping ring (23) is held in position to the groove (212) on. the locking pin (21) against the edge of the through hole (112) at the top of the pivoting ear (11) to restrict the locking pin (21) from sliding down. A portion of the locking pin (21) is longitudinally penetrating into the arc recess (111) of the pivoting ear (11). As illustrated in FIG. 5, upon mounting the door panel (1) to the body of the oven (3), both of the handles (211) of the respective locking pin (21) provided on both sides of the door panel (1) are pulled so that the spring (22) is compressed by the stopper (213) provided at the end of the locking pin (21), and the stopper (213) retreats to the inner space (14) inside the pivoting ear (11). Then each of the pivoting post (31) protruding from the body of the oven (3) is inserted into the arc recess (111) of the door panel (1), and the locking pin (21) is released so to extend once again into the arc recess (111) by the return force of the spring (22). Finally the locking pin (21) holds against the peripheral of the pivoting post (31) for the door panel (1) to be pivoted to the body of the oven (3).

Figure 6:
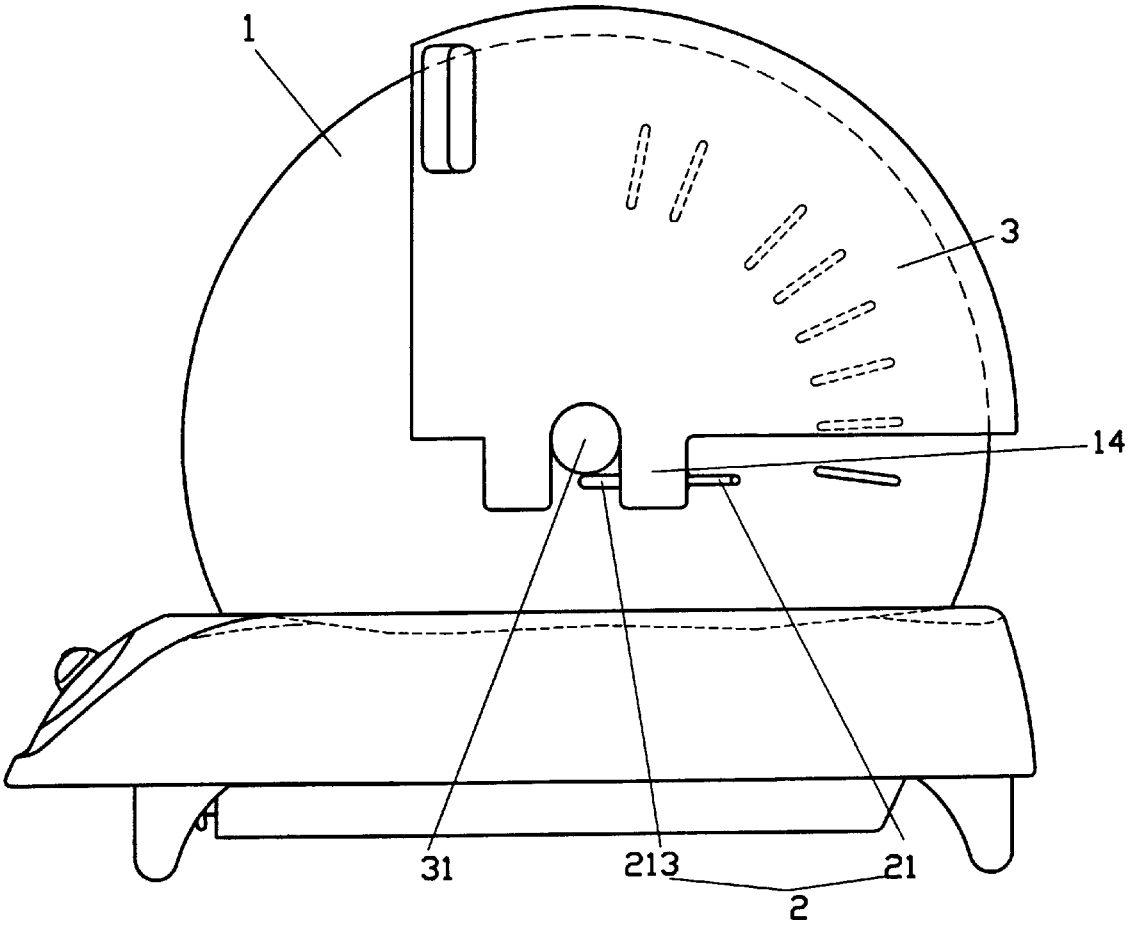
FIG. 6 is a schematic view of the preferred embodiment of the present invention with its door panel lifted up.

When the body of the oven (3) is used for roasting, or requires cleaning, both of the handles (211) respectively to locking pin (21) are pulled at the same time for the locking pin (21) to retreat into the inner space (14), then the door panel (1) can be easily removed and assembled. As illustrated in FIG. 6, the door panel (1) of the preferred embodiment of the present invention is lifted up compromising to the arc surface of the body of the oven (3) for achieving the purpose of space saving. It is also safe to prevent burning the user because that once lifted up, the door panel (1) stays well in position at the rear half of the body of the oven (3).

What is claimed is:

1. An oven comprising:

(a) an oven body having a pair of spaced pivoting posts protruding therefrom, said pivoting posts opposing one another to define a pivot axis;

(b) an oven door panel coupled in pivotally displaceable manner to said oven body, said oven door panel having a pair of spaced sides each having formed thereon at least a pair of pivoting ear portions defining an arc recess therebetween, each said arc recess releasably engaging one said pivoting post of said oven body, at least one said pivoting ear portion having formed therein an inner space, said sides of said oven door panel each including a substantially planar sidewall surface having a plurality of fastening tabs extending therefrom, and a lid fastened thereto having a substantially planar surface opposing said sidewall surface, said inner space being defined between said lid and sidewall surfaces; and, (c) a pair of pivoting units respectively coupled to said sides of said oven door panel, each said pivoting unit including:

(1) a longitudinally extended locking pin passing through said inner space of at least one said pivoting ear portion, each said locking pin being displaceable between holding and releasing positions, said locking pin extending at least partially into one said arc recess for locking said engagement there of with said pivoting post; and, (2) a spring coupled to said locking pin for resiliently biasing said locking pin into said holding position.

* * * * *